US005919312A

United States Patent [19]

Wierenga et al.

[11] Patent Number: 5,919,312

[45] Date of Patent: Jul. 6, 1999

[54] COMPOSITIONS AND METHODS FOR REMOVING OILY OR GREASY SOILS

[75] Inventors: Thomas James Wierenga, Cincinnati; James August Weikel, Fairfield; David Charles Underwood, Cincinnati, all of Ohio

[73] Assignee: The Procter & Gamble Company, Cincinnati, Ohio

[21] Appl. No.: 08/819,281

[22] Filed: Mar. 18, 1997

[51] Int. Cl.[6] ..... B08B 3/00

[52] U.S. Cl. ..... 134/34; 134/19; 134/22.19; 134/25.12; 134/40; 134/35; 134/42; 510/237; 510/337; 510/341; 510/350; 510/356; 510/433; 510/503

[58] Field of Search ..... 134/19, 22.19, 134/25, 2, 40, 42, 34, 35; 510/237, 350, 337, 341, 356, 503, 433

[56] References Cited

U.S. PATENT DOCUMENTS

| | | | |
|---|---|---|---|
| 3,658,711 | 4/1972 | Mukai et al. | 252/90 |
| 3,813,343 | 5/1974 | Mukai et al. | 252/111 |
| 4,116,848 | 9/1978 | Schoenholz et al. | 252/90 |
| 4,193,886 | 3/1980 | Schoenholz et al. | 252/90 |
| 4,214,915 | 7/1980 | Dillarstone et al. | 134/19 |
| 4,289,640 | 9/1981 | Falivene | 252/95 |
| 5,164,118 | 11/1992 | Sauer et al. | 510/237 X |
| 5,188,769 | 2/1993 | Connor et al. | 510/237 X |
| 5,194,639 | 3/1993 | Connor et al. | 554/66 |
| 5,223,179 | 6/1993 | Connor et al. | 510/237 X |
| 5,318,728 | 6/1994 | Surutzidis et al. | 510/306 X |
| 5,332,528 | 7/1994 | Pan et al. | 510/299 |
| 5,338,487 | 8/1994 | Connor et al. | 252/357 |
| 5,364,551 | 11/1994 | Lentsch et al. | 252/156 |
| 5,376,310 | 12/1994 | Cripe et al. | 252/548 |
| 5,380,454 | 1/1995 | Griepenburg et al. | 252/174.14 |
| 5,380,891 | 1/1995 | Connor et al. | 554/69 |
| 5,500,153 | 3/1996 | Figueroa et al. | 510/292 |

FOREIGN PATENT DOCUMENTS

| | | |
|---|---|---|
| 103 466 A1 | 8/1993 | European Pat. Off. . |
| 94/28108 | 12/1994 | WIPO . |
| 95/20027 | 7/1995 | WIPO . |
| 95/20028 | 7/1995 | WIPO . |

*Primary Examiner*—Arlen Soderquist
*Attorney, Agent, or Firm*—Karen F. Clark; Daniel F. Nesbitt

[57] ABSTRACT

Composition for cleaning cooking surfaces comprises, by weight, from about 0.5% to about 10% of a surfactant selected from the group consisting of polyhydroxy fatty acid amide surfactants having the formula:

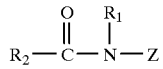

wherein $R_1$ is H, methyl, ethyl, propyl, butyl, 2-hydroxyl ethyl or 2-hydroxy propyl; $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative of the polyhydroxyhydrocarbyl wherein at least one of the hydroxyls is alkoxylated; from about 0% to about 10% of a surfactant selected from the group consisting of amine oxide surfactants having the formula:

$$R_3R_4R_5N \rightarrow O$$

wherein $R_3$ is an alkyl having from about 8 to about 16 carbon atoms, and $R_4$ and $R_5$ are each independently methyl or ethyl; and mixtures thereof; from about 0.5% to about 10% of an amine; from about 0% to about 12% of an alkalinity source other than amines; greater than about 20% a polyhydric alcohol other than the polyhydroxy fatty acid amide surfactant and water. The composition has a pH of no less than about 8.

20 Claims, No Drawings

COMPOSITIONS AND METHODS FOR REMOVING OILY OR GREASY SOILS

FIELD OF THE INVENTION

This invention relates to a composition for and a method of removing oily or greasy soils from surfaces. In particular, the invention relates to a non-corrosive cleaning composition capable of softening deposits of oily or greasy soils.

BACKGROUND OF THE INVENTION

Cooking surfaces such as grills and oven interiors are often soiled with deposits of baked-on or cooked-on foods, in particular deposits of baked-on or cooked-on oily or greasy food. Cleaning compositions containing high amounts of caustic compounds such as hydroxides can be used to clean cooking surfaces, but these compositions are often corrosive to the skin and eyes, i.e., they can damage tissues. Oily or greasy soils can deposit on counters or walls near a cooking surface, unfortunately caustic solutions are capable of producing damage to painted surfaces, chrome and aluminum.

Additionally, many oven cleaning compositions require the presence of heat to be effective. Operators may be burned when applying such compositions to a hot cooking surface. Some oven cleaner are effective at room temperature, but require the presence of volatile or toxic solvents. Other grill and oven cleaning compositions are in powder form; since powders are not conveniently applied to surfaces such as oven walls, these powders may require the addition of water to form liquids, foams or gels.

Mukai et al., U.S. Pat. No. 3,658,711 disclose oven cleaning compositions comprising soap, inorganic cleaner, and an enhancer of the formula:

$$NH_2CH_2CH_2CH_2—(OCH_2CH_2)_n—OH$$

wherein n is a number from about 2 to about 12. Suitable inorganic cleaners include, for example, carbonates. The compositions can also contain humectants such as propylene glycol and glycerol, and are disclosed as effective at room temperature.

Mukai et al., U.S. Pat. No. 3,813,343, disclose cleaning compositions suitable for use as oven cleaners and comprising surfactant, a non-caustic inorganic cleaner such as carbonates, an amine and/or ammonia, and organic solvent insoluble or partially soluble in water, and dimethyl sulfoxide. The compositions can also contain humectants such as propylene glycol and glycerol, and are effective a room temperature.

Schoenholz et al., U.S. Pat. No. 4,116,848, disclose cleaning compositions suitable for use as oven cleaners and comprising at least one alkali metal salt of a weak organic acid. The compositions can include cationic surfactants such as amines without intermediate linkages. The compositions can also comprise alkaline finely divided materials such as alkaline earth carbonates, and polyhydric alcohols such as, for example, glycerol, ethylene glycol, and diethylene glycol. Schoenholz et al. disclose that for oven cleaning it is preferred to operate at temperatures between 250° F. and 550° F.

Schoenholz et al., U.S. Pat. No. 4,193,886, disclose weakly alkaline cleaning compositions suitable for use as oven cleaners comprising at least one polyhydric alcohol, at least one alkali metal bicarbonate, and at least one alkali metal salt of a weak organic acid. The compositions can include cationic surfactants such as amines without intermediate linkages. Schoenholz et al. disclose that the compositions are effective without the need to heat the ovens above the moderate temperatures used in cooking, for example 300° F. to 350° F.

Dillarstone et al., U.S. Pat. No. 4,214,915 disclose oven cleaner compositions comprising, by weight, from 1% to 2% sodium bicarbonate and from 14% to 17% potassium bicarbonate in a weight ratio of sodium bicarbonate to potassium bicarbonate of from 1:7 to 1:17. The compositions may also comprise surfactant. The compositions are applied to a soiled cooking surface at a temperature of approximately 200° F., and the surface is then heated to approximately 475° F. before being allowed to cool. The softened deposits are then removed.

Falivene, U.S. Pat. No. 4,289,640, discloses dry powder cleaning suitable for use as oven and grill cleaner compositions and comprising a synthetic organic detergent, an organic hydrotrope, an abrasive, and a detergent builder; the powder can optionally contain anti-dusting agents such as propylene glycol. Suitable detergents include amine oxides, and suitable builder salts include alkali metal carbonates or alkali metal bicarbonates.

Lentsch et al., U.S. Pat. No. 5,364,551, disclose a reduced misting oven cleaner having a particle size of greater than 170 um, and comprising an alkali metal hydroxide, an organic surfactant, an organic polymer thickener, and water. Suitable surfactants include amine oxides. The composition can comprise a strong base, including, for example, monoethanolamine, diethanolamine, triethanolamine, sodium hydroxide, and potassium hydroxide, and an aqueous compatible solvent, including, for example, ethylene glycol, diethylene glycol, triethylene glycol, and propylene glycol. The compositions are disclosed as effective at room temperature.

Griepenburg et al., U.S. Pat. No. 5,380,454, disclose oven cleaning compositions comprising from 1% to 12% monoethanolamine, from 2% to 20% diethylene glycol monobutyl ether and from 1% to 10% sodium or potassium bicarbonate. The compositions can comprise surfactants and are effective at room temperature.

R & C Products PTY, Limited, EPO 0 103 466 A1, discloses oven cleaning compositions comprising non-caustic alkali metal carbonate, sesquicarbonate or bicarbonate; water and a polyhydric alcohol. The compositions can also comprise surfactants. The compositions are applied to a soiled cooking surface at a temperature of approximately 125° C., and the softened deposits are then removed.

Ecolab Inc., WO 94/28108, discloses thickened aqueous cleaning compositions suitable for removing baked-on soils. The thickening system contains an amine, quaternary amine, or amine oxide. The compositions can contain a source of alkalinity; suitable sources include strong nitrogen bases such as ammonia, monoethanolamine, diethanolamine, and triethanolamine, and inorganic bases such as sodium or potassium hydroxide. The compositions can also comprise glycol ether solvents such as, for example, diethylene glycol and propylene glycol. The compositions are disclosed as effective at low to moderate temperatures (50° F. to 140° F.).

Cripe et al., U.S. Pat. No. 5,376,310, disclose light-duty liquid or gel dishwashing compositions comprising alkyl ethoxy carboxylate surfactant, magnesium ions, magnesium chelating agent, and a buffering agent to maintain the pH of the compositions from about 8 to 10. The buffering agent may be an amine. The compositions may also comprise co-surfactants, such as polyhydroxy fatty acid amide surfactants and amine oxide surfactants, and from 0% to 15% of alcohol, such as propylene glycol.

There is a continuing need for safe, non-corrosive oven and grill cleaning compositions capable of effective cleaning.

SUMMARY OF THE INVENTION

It is an object of this invention to obviate various problems of prior art cleaners.

It is another object of this invention to provide a cleaning composition for cooking surfaces which can be used on both room temperature and heated surfaces.

It is yet another object of this invention to provide a method for cleaning cooking surfaces using a composition which is non-corrosive to tissue, i.e. will not damage tissues and will not harm eyes and skin.

In accordance with one aspect of the present invention there is provided a composition comprising, by weight, from about 0.5% to about 10% of a surfactant selected from the group consisting of polyhydroxy fatty acid amide surfactants having the formula:

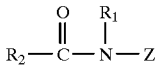

wherein $R_1$ is H, methyl, ethyl, propyl, butyl, 2-hydroxyl ethyl or 2-hydroxy propyl; $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative of the polyhydroxyhydrocarbyl wherein at least one of the hydroxyls is alkoxylated; from about 0% to about 10% of a surfactant selected from the group consisting of amine oxide surfactants having the formula:

$$R_3R_4R_5N\rightarrow O$$

wherein $R_3$ is an alkyl having from about 8 to about 16 carbon atoms, and $R_4$ and $R_5$ are each independently methyl or ethyl; from about 0.5% to about 10% of an amine; from about 0% to about 12% of an alkalinity source other than amines; greater than about 20% of a polyhydric alcohol other than the polyhydroxy fatty acid amide surfactant and water. The composition has a pH of no less than about 8.

In accordance with another aspect of the present invention there is provided a composition comprising, by weight, from about 0.5% to about 10% of a surfactant selected from the group consisting of polyhydroxy fatty acid amide surfactants having the formula:

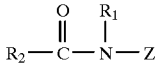

wherein $R_1$ is H, methyl, ethyl, propyl, butyl, 2-hydroxyl ethyl or 2-hydroxy propyl; $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative of the polyhydroxyhydrocarbyl wherein at least one of the hydroxyls is alkoxylated; from about 0% to about 10% of a surfactant selected from the group consisting of amine oxide surfactants having the formula:

$$R_3R_4R_5N\rightarrow O$$

wherein $R_3$ is an alkyl having from about 8 to about 16 carbon atoms, and $R_4$ and $R_5$ are each independently methyl or ethyl; from about 1% to about 16% of an alkalinity source other than amines; greater than about 20% of a polyhydric alcohol other than the polyhydroxy fatty acid amide surfactant and water. The total surfactant content of the composition is from about 0.5% to about 10%, and the composition has a pH of no less than about 8.

In accordance with an additional aspect of the present invention there is provided a method for cleaning a cooking surface comprising the steps of (a) applying to the cooking surface a cleaning composition comprising, by weight, from about 0.5% to about 10% of a surfactant selected from the group consisting of polyhydroxy fatty acid amide surfactants having the formula:

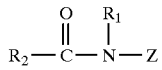

wherein $R_1$ is H, methyl, ethyl, propyl, butyl, 2-hydroxyl ethyl or 2-hydroxy propyl; $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative of the polyhydroxyhydrocarbyl wherein at least one of the hydroxyls is alkoxylated; from about 0% to about 10% of a surfactant selected from the group consisting of amine oxide surfactants having the formula:

$$R_3R_4R_5N\rightarrow O$$

wherein $R_3$ is an alkyl having from about 8 to about 16 carbon atoms, and $R_4$ and $R_5$ are each independently methyl or ethyl; from about 0.5% to about 10% of an amine; from about 0% to about 12% of an alkalinity source other than amines; greater than about 20% of a polyhydric alcohol other than the polyhydroxy fatty acid amide surfactant; and water; (b) waiting a sufficient time for the composition to soften deposits of food or grease; and (c) removing the composition.

DETAILED DESCRIPTION OF THE INVENTION

The present invention encompasses improved compositions and methods for removing oily or greasy soils from surfaces. The surfaces can be hard surfaces such as walls, counters, and cooking surfaces. As used herein, the term "cooking surfaces" is intended to include such surfaces as oven interiors, grills, broilers and rotisseries. The surfaces may also include soft surfaces such as fabrics; compositions according to the present invention can be used to pre-treat oily or greasy soils on fabrics.

As used herein, the term "deposits" is intended to include baked-on, cooked-on and dried-on greasy or oily soils, including baked-on, cooked-on and dried-on food. Cleaning compositions according to the invention are efficient at softening even cooked-on fat and grease deposits. As used herein, the term "softened" is intended to mean that deposits on a hard surface arc rendered removable by wiping. After the deposits are softened they can easily be removed by wiping with a cloth or sponge.

Compositions according to the invention offer a high degree of safety in that they are not corrosive to skin or eyes. Additionally, in a preferred embodiment the compositions can be used on cooking surfaces which are at room temperature, thereby avoiding accidental bums.

As used herein, all parts, percentages, ppm and ratios are based on weight of the composition, and the materials are assumed to be 100% active, unless otherwise specified.

The cleaning composition of the present invention comprises, by weight, from about 0.5% to about 10%, preferably about 0.5% to about 5%, most preferably about 0.5% to about 3.5%, of a surfactant selected from the group consisting of polyhydroxy fatty acid amide surfactants having the formula:

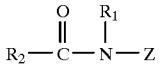

wherein $R_1$ is H, methyl, ethyl, propyl, butyl, 2-hydroxyl ethyl or 2-hydroxy propyl; $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative of the polyhydroxyhydrocarbyl wherein at least one of the hydroxyls is alkoxylated; from about 0% to about 10%, preferably about 0.5% to about 10%, more preferably about 0.5% to about 5%, of a surfactant selected from the group consisting of amine oxide surfactants having the formula:

$$R_3R_4R_5N\rightarrow O$$

wherein $R_3$ is an alkyl having from about 8 to about 16 carbon atoms, and $R_4$ and $R_5$ are each independently methyl or ethyl; greater than about 20%, preferably from about 30% to about 60%, more preferably from about 35% to about 45%, of a polyhydric alcohol other than the polyhydroxy fatty acid amide surfactant and water. The composition has a pH value of no less than about 8, preferably of no less than about 9.

In one embodiment the composition is capable of softening deposits on both room temperature and heated surfaces and comprises, by weight, from about 0.5% to about 10%, preferably from about 2% to about 10%, more preferably from about 5% to about 7%, of an amine and from about 0% to about 12%, preferably from about 0% to about 5%, of an alkalinity source other than amine. In another embodiment the composition is capable of softening deposits on heated surfaces and comprises, by weight, from about 1% to about 16%, preferably from about 5% to about 14%, of an alkalinity source other than amine. As used herein, "heated surfaces" is intended to mean surfaces heated to at least about 250° F. (120° C.), preferably between about 250° F. (120° C.) to about 400° F. (205° C.), more preferably between about 250° F. (120° C.) to 350° F. (175° C.).

Preferably the composition has a flash point of no less than about 100° F. (40° C.), more preferably no less than about 150° F. (65° C.), and most preferably no less than about 200° F. (95° C.). Generally liquid dishwashing compositions comprise low boiling point alcohols such as, for example, ethanol or isopropanol, and have flash points of less than about 100° F. Such liquid dishwashing compositions are unsuitable for cleaning heated cooking surfaces, for if the flash point of the liquid dishwashing compositions are reached the resulting flash could ignite nearby combustibles.

SURFACTANTS

The composition comprises, by weight, from about 0.5% to about 10%, preferably from about 0.5% to about 5%, more preferably from about 0.5% to about 3.5%, polyhydroxy fatty acid amide surfactant, and from about 0% to about 10%, preferably from about 0.5% to about 10%, even preferably from about 0.5% to about 5%, and most preferably from about 0.5% to about 3.5%, amine oxide surfactant. Preferably the composition contains a mixture of both polyhydroxy fatty acid amide surfactant and amine oxide surfactant. The weight ratio of polyhydroxy fatty acid amide surfactant to amine oxide surfactant is preferably from about 3:1 to about 1:3, more preferably the ratio is about 3:2. Preferably the composition comprises, by weight, from about 0.5% to about 10%, more preferably from about 0.5% to about 5%, even more preferably from about 0.5% to about 3.5%, most preferably from about 1% to about 3%, total surfactant.

It is a feature of the invention that the composition comprises at least one polyhydroxy fatty acid amide surfactant, such as those disclosed in U.S. Pat. No. 5,376,310, incorporated herein by reference. Suitable polyhydroxy fatty acid amide surfactants have the formula:

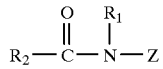

wherein $R_1$ is H, methyl, ethyl, propyl, butyl, 2-hydroxyl ethyl or 2-hydroxy propyl, preferably methyl or ethyl, more preferably methyl; $R_2$ is a $C_5$–$C_{31}$ hydrocarbyl, preferably a $C_8$–$C_{20}$ alkyl or alkenyl, more preferably a $C_{10}$–$C_{18}$ alkyl or alkenyl; and Z is a polyhydroxyhydrocarbyl having a linear hydrocarbyl chain with at least 3 hydroxyls directly connected to the chain, or an alkoxylated derivative of a polyhydroxyhydrocarbyl having a linear hydrocarbyl chain with at least 3 hydroxyls directly connected to the chain wherein at least one of the hydroxyls is alkoxylated. Preferably Z is derived from a reducing sugar in a reductive amination reaction, more preferably Z in glycityl.

Suitable reducing sugars include glucose, fructose, maltose, lactose, galactose, mannose, and xylose. Z will preferably be selected from the group consisting of $—CH_2—(CHOH)_n—CH_2OH$, $—CH(CH_2OH)—(CHOH)_{n-1}—CH_2OH$, and $—CH—(CH_2OH)_2(—CHOR')(CHOH)—CH_2OH$, wherein n is 3, 4, or 5, and R' is a cyclic or aliphatic monosaccharide or alkoxylated derivatives thereof, or H. Particularly preferred is $—CH_2—(CHOH)_4—CH_2OH$. The polyhydroxy fatty acid amide surfactants can be synthesized according to the methods disclosed in U.S. Pat. Nos. 5,194,639, 5,380,893 and 5,338,487, incorporated herein by reference.

Suitable amine oxide surfactants include the amine oxide surfactant having the formula:

$$R_3R_4R_5N\rightarrow O$$

wherein $R_3$ is an alkyl having from about 8 to about 16, preferably from about 12 to about 16, and more preferably from about 12 to about 14, carbon atoms; and $R_4$ and $R_5$ are each independently methyl or ethyl, preferably methyl. Examples of suitable amine oxide include dodecyidimethyl amine oxide, tetradecyidimethyl amine oxide, hexadecyldimethyl amine oxide, octadecyidimethyl amine oxide, and coconut alkyl dimethyl amine oxides.

The composition can comprise auxiliary surfactants. However, the total surfactant level is preferably less than about 10%. At surfactant levels above 10% it is generally necessary to increase the water level and decrease the polyhydric alcohol level in order to maintain all the ingredients in solution; this generally decreases the efficacy of the composition.

Preferably the composition comprises, by weight, no more than about 2%, more preferably no more than about 1%, even more preferably no more than about 0.5%, and most preferably is free of, auxiliary surfactants. Generally nonionic surfactants perform better than anionic or cationic surfactants, for nonionic surfactants are more soluble in the composition. If auxiliary surfactants are included in the composition, preferably the auxiliary surfactants are zwitterionic surfactants which are neutral at the pH of the compositions, for example, betaines, or nonionic surfactants. Preferably the composition is substantially free of anionic surfactants; as used herein "substantially free on anionic surfactants" is intended to mean the composition comprises no more than about 2%, by weight, anionic surfactants. More preferably the composition comprises, by weight, no more than about 1%, even more preferably no more than about 0.5%, and most preferably is free of, anionic surfactants

AMINES

In one embodiment, the composition is capable of softening deposits on both room temperature surfaces and heated surfaces. It is a feature of this embodiment that the composition comprises an amine. As used herein, the term is intended to include ammonia, primary amines, secondary amines, and tertiary amines; however, the term is not intended to include quaternary ammonium surfactants. The addition of cationic quaternary ammonium surfactants decreases the effectiveness of the composition.

The composition comprises, by weight, from about 0.5% to about 10%, preferably from about 2% to about 10%, and most preferably from about 5% to about 7%, amine. Preferably the amine has a $pK_a$ of at least about 8, more preferably of at least about 9. The amine preferably has a boiling point of about 95° F. (35° C.) or greater and preferably has a flash point of about 150° F. (65° C.) or greater. Suitable amines include monoethanolamine, diethanolamine, triethanolamine, dimethylaminomethylpropanol, diethylaminoethanol, aminomethylpropanol, aminobutanol, monoisopropanolamine, dimethylethanolamine, aminoethylpropanediol, aminomethylpropanediol, diisopropanolamine, morpholine, tris(hydroxymethyl) aminomethane, triisopropanolamine and mixtures thereof. Monoethanolamine, diethanolamine, and triethanolamine are preferred, monoethanolamine is most preferred. Although ammonia can be used, the composition preferably is substantially free of, more preferably free of, ammonia due to its irritant nature. As used herein, "substantially free of ammonia" is intended to mean less than 5%, preferably less than 1%, by weight.

ALKALINITY SOURCE

In one embodiment the composition comprises an alkalinity source other than amine, and is capable of softening deposits on surfaces which are heated to about 250° F. or higher. The composition comprises, by weight, from about 1% to about 16%, preferably from about 5% to about 14%, of an alkalinity source other than amine.

In another embodiment, the composition comprises an amine and is capable of softening deposits on both room temperature surfaces and heated surfaces. Although this embodiment does not require a source of alkalinity other than the amine, the composition can optionally comprises, by weight, from about 0% to about 12%, preferably from about 0% to about 5%, of an alkalinity source.

The alkalinity source is present in an amount sufficient to obtain the desired composition pH. The composition has a pH of from about 8 to about 14, preferably from about 9 to about 14. In one preferred embodiment, the composition has a pH of from about 12 to about 14; this pH range generally results in a faster cleaning effect. In another preferred embodiment the composition has a pH of from about 9 to about 12; this pH range generally results in compositions which are less corrosive to the skin and eyes.

Suitably alkalinity sources include alkali metal bicarbonate salts, alkali metal carbonate salts, alkali metal hydroxides and mixtures thereof. Preferably the alkalinity source has a $pK_a$ of at least about 8, more preferably of $pK_a$ of at least about 9. Sodium and potassium bicarbonate are preferred as they are not as strongly alkaline as hydroxides and do not ten to have corrosive or irritating effects of tissues. Potassium bicarbonate is more preferred as it is more soluble in water than sodium bicarbonate; also, the potassium soaps which form from the reaction of potassium bicarbonate and fats are softer than the sodium soaps which form from the reaction of sodium bicarbonate and fats.

Some acid may be added in order to adjust the pH, provided that the final pH is about 8 or above, preferably about 9 or above. Suitable acids include mineral acids such as hydrochloric and sulfuric acids, and organic acids such as acetic acid.

POLYHYDRIC ALCOHOL

The composition comprises, by weight, greater than about 20%, preferably from about 30% to about 60%, more preferably from about 35% to about 50%, most preferably from about 35% to about 45%, of a polyhydric alcohol other than the polyhydroxy fatty acid amide surfactant. The polyhydric alcohols slow the evaporation of the composition. The polyhydric alcohols of the present composition are liquids which are miscible with water and have high boiling points. Preferably, the boiling point of the polyhydric alcohol is about 200° F. (90° C.) or greater, more preferably about 300° F. (150° C.) or greater, and most preferably about 400° F. (205° C.) or greater. Low boiling point (below 200° F.) polyhydric alcohols are not preferred since they will boil if used to clean heated surfaces. Suitable polyhydric alcohols include glycerol, diethylene glycol, triethylene glycol, 1,2-hexanediol and mixtures thereof; glycerol is preferred as it tends to both slow evaporation of the composition and aid in dissolving grease.

Auxiliary solvents other than polyhydric alcohols can be included, however, preferably the composition is substantially free of, more preferably free of, auxiliary solvents. The composition is preferably substantially free of, more preferably free of, monohydric alcohols as the monohydric alcohols are not as effective at solubilizing the deposits as the polyhydric alcohols. Preferably the composition is substantially free of, more preferably free of, cellosolves as these solvents are toxic. As used herein, "substantially free of auxiliary solvents, monohydric alcohols, or cellosolves" is intended to mean less than 5%, preferably less than 1%, by weight.

ADDITIONAL INGREDIENTS

The composition comprises a sufficient amount of water to solubilize all ingredients. Generally the composition comprises at least about 30% water, preferably at least about 40% water.

The composition can comprise additional ingredients such as thickeners, hydrotropes and dyes. Perfumes can used in the composition provided the flash point of the composition is no less than about 100° F. If the composition is be applied to vertical surfaces such as oven walls, the composition will preferably contain thickeners. In a preferred embodiment the composition comprises from about 0% to about 0.2% thickener. Suitable thickeners comprise carboxymethyl cellulose, carboxyethyl cellulose, colloidal magnesium aluminum silicate, and xanthan gum. If the composition is in the form of an aerosol liquid which foams, the composition can contain foam stabilizers. If the composition is in the form of a liquid which is to be brushed onto the surfaces, the composition can contain foam suppressors.

METHODS OF USE

In a preferred embodiment of the invention the composition is a cleaning composition for cooking surfaces. Deposits of food and grease can be removed from cooking surfaces such as ovens, grills, or broilers by applying the composition, waiting a sufficient time for the composition to soften the deposits, and removing the composition and softened deposits. The composition can be applied as a spray or with a brush or sponge. In one spray embodiment, the composition is applied with a manually operated pump spray device. The composition can also comprise a propellant which does not react adversely with the composition. In another spray embodiment, the composition is applied as an aerosol from a pressurized container.

The composition and softened deposits can be removed by wiping with an absorbent material such as a cloth or sponge. When the composition is used to clean hard surfaces such as walls, rinsing will not be required provided the surface is thoroughly wiped. When the compositions is used to clean cooking surfaces, the cooking surface will preferably be rinsed with water after the composition and softened deposits are removed by wiping.

The amount of time sufficient to soften the deposits depends upon factors such as frequency of cleaning, amount of baked-on or cooked-on grease, the pH of the composition, and the temperature of the cooking surfaces. The composition can be left on a cooking surface at room temperature surface for an extended period of time, for example overnight, if desired. Although the composition can remain on the cooking surface from about 10 minutes to about 16 hours, generally the composition requires from about 10 minutes to about one hour to soften deposits on a room temperature surface. If the surface is heated to about 250° F. during cleaning, the time required may be as short at from about 45 seconds to about 10 minutes.

EXAMPLE 1

An example composition comprising an amine and an alkalinity source other than amine is as follows:

| Example 1A | |
|---|---|
| 1.2% | Polyhydroxy Fatty Acid Amide Surfactant |
| 0.8% | Amine Oxide Surfactant |
| 5.0% | Monoethanolamine |
| 0.15% | Carboxy Methyl Cellulose |
| 5% | Potassium Bicarbonate |
| 42.85% | Glycerol |
| 45% | Water |

The composition has a pH of about 11.6, and is capable of removing baked-on grease from an unheated (i.e. room temperature) cooking surface. The composition can be painted on the cooking surface with a brush or sponge, or sprayed on the cooking surface. After sufficient time to soften the baked-on grease, the composition can be wiped from the cooking surface; if desired the cooking surface can be heated to shorten the time necessary to soften the deposits. Preferably the cooking surface will then be rinsed with water.

An example composition which comprising an alkalinity source other than amine is as follows:

| Example 1B | |
|---|---|
| 0.5% | Polyhydroxy Fatty Acid Amide Surfactant |
| 12.0% | Potassium Bicarbonate |
| 39.5% | Glycerol |
| 48.0% | Water |

The composition has a pH of from about 9 to about 10, and is capable of removing baked-on grease from a heated cooking surface. The composition can be painted on the cooking surface with a brush or sponge, or sprayed on the cooking surface. After sufficient time to soften the baked-on grease, the composition can be wiped from the cooking surface. Preferably the cooking surface will then be rinsed with water.

EXAMPLE 2

Two examples (2A and 2B) of compositions according to the invention, and two comparative examples outside of the scope of the claims (2C and 2D) were prepared. The compositions comprised, by weight, varying amounts of polyhydroxy fatty acid amide surfactant and amine oxide surfactant. The pH of the compositions was from about 9 to about 10. The compositions were as follows:

| Ingredient | Example 2A % by weight | Example 2B % by weight | Comparative Example 2C % by weight | Comparative Example 2D % by weight |
|---|---|---|---|---|
| Polyhydroxy Fatty Acid Amide Surfactant | 0.64 | 0.64 | 0 | 0 |
| Amine Oxide Surfactant | 0.54 | 0 | 0.54 | 0 |
| Potassium Bicarbonate | 12 | 12 | 12 | 12 |
| Glycerol | 50 | 50 | 50 | 50 |
| Water | Balance | Balance | Balance | Balance |

The compositions were tested for the ability to remove deposits of baked-on grease. A 3 gram sample of hamburger grease was spread on a 3 inch by 12 inch stainless steel sheet. The stainless steel sheet was then baked in a forced-air oven for 1 hour at 350° F., and aged overnight at room temperature. The stainless steel sheet was placed on a hot plate and heated to 250° F., and a 35 microliter sample of each example composition and each comparative example composition was dispensed onto the surface of the plate. When it became visually apparent that the deposits were starting to soften and loosen from the stainless sheet, the sheet was rinsed with water and allowed to cool. Generally the period of time require for softening of the deposits was from about 1 minute to about 5 minutes. The compositions were graded visually for percent soil removal. A panel of four individuals visually rated the results on a scale of 0% (none of the deposit removed) to 100% (all of the deposit removed). The results were as follows:

| Composition | Results (% deposit removed) |
|---|---|
| Example 2A | 100 |
| Example 2B | 95 |
| Comparative Example 2C | 48 |
| Comparative Example 2D | 5 |

Example compositions 2A and 2B, which comprise polyhydroxy fatty acid amide surfactant, were more effective at softening deposits of baked-on grease than comparative examples 2C and 2D, which did not comprise polyhydroxy fatty acid amide surfactant.

EXAMPLE 3

Two examples (3A and 3B) of compositions according to the invention, and three comparative examples outside the scope of the claims (3C, 3D and 3E) were prepared. The compositions comprised, by weight, varying amounts of glycerol. The pH of the compositions was from about 9 to about 10. The compositions were as follows:

| Ingredient | Example 3A % by weight | Example 3B % by weight | Comparative Example 3C % by weight | Comparative Example 3D % by weight | Comparative Example 3E % by weight |
|---|---|---|---|---|---|
| Polyhydroxy Fatty Acid Amide Surfactant | 0.64 | 0.64 | 0.64 | 0.64 | 0.64 |
| Amine Oxide Surfactant | 0.54 | 0.54 | 0.54 | 0.54 | 0.54 |
| Potassium Bicarbonate | 12 | 12 | 12 | 12 | 12 |
| Glycerol | 40 | 30 | 20 | 10 | 0 |
| Water | Balance | Balance | Balance | Balance | Balance |

The example compositions and comparative example compositions were tested as described in Example 2. The results were as follows:

| Composition | Results (% deposit removed) |
|---|---|
| Example 3A | 73 |
| Example 3B | 38 |
| Comparative Example 3C | 1 |
| Comparative Example 3D | 1 |
| Comparative Example 3E | 1 |

Example compositions 3A and 3B were more effective at softening deposits of baked-on grease than comparative example compositions 3C, 3D and 3E, which comprise less than 30% polyhydric alcohol.

EXAMPLE 4

One example (4A) of a composition according to the invention, and three comparative examples outside the scope of the claims (4C, 4D and 4E) were prepared. Example 4A comprised polyhydroxy fatty acid amide surfactant and amine oxide surfactant according to the invention; comparative example 4C and 4D contained amphoteric surfactants (sodium cocoamphoacetate and disodium capryloamphodipropionate, respectively) and comparative example 4E contained an anionic surfactant (oleoyl sarcosine). The pH of the compositions was from about 9 to about 10. The compositions were as follows:

| Ingredient | Example 4A % by weight | Comparative Example 4B % by weight | Comparative Example 4C % by weight | Comparative Example 4D % by weight |
|---|---|---|---|---|
| Polyhydroxy Fatty Acid Amide Surfactant | 0.64 | 0 | 0 | 0 |
| Amine Oxide Surfactant | 0.54 | 0 | 0 | 0 |
| Sodium Cocoampho-acetate | 0 | 0.5 | 0 | 0 |
| Disodium Caprylo-amphodi-propionate | 0 | 0 | 0.5 | 0 |
| Oleoyl Sarcosine | 0 | 0 | 0 | 0.5 |
| Potassium Bicarbonate | 12 | 12 | 12 | 12 |
| Glycerol | 50 | 50 | 50 | 50 |
| Water | Balance | Balance | Balance | Balance |

The example composition and comparative example compositions were tested as described in Example 2. The results were as follows:

| Composition | Results (% deposit removed) |
|---|---|
| Example 4A | 65 |
| Comparative Example 4B | 66 |
| Comparative Example 4C | 1 |
| Comparative Example 4D | 31 |

Comparative examples 4C and 4D were less effective at softening deposits of baked-on grease than the example composition. Although comparative example 4B was effective in softened the deposits, the surfactant tended to form crystals and to come out of solution. Example 4A, a composition according to the present invention, formed a more stable solution.

EXAMPLE 5

Four examples of compositions according to the invention were prepared. The base composition was as follows:

| Ingredient | Base Composition % by weight |
|---|---|
| Polyhydroxy Fatty Acid Amide Surfactant | 0.64 |
| Amine Oxide Surfactant | 0.54 |
| Potassium Bicarbonate | 12 |
| Glycerol | 50 |
| Water | Balance |

The compositions were adjusted to have a pH of 9.6 (Example 5A), a pH of 10 (Example 5B), a pH of 10.5 (Example 5C), or a pH of 11 (Example 5D), The example compositions were tested as described in Example 2. The results were as follows:

| Composition | Results (% deposit removed) |
|---|---|
| Example 5A (pH 9.6) | 56 |
| Example 5B (pH 10) | 64 |
| Example 5C (pH 10.5) | 54 |
| Example 5D (pH 11) | 89 |

In a separate test a composition was prepared using the base composition adjusted to a pH of 7. After 5 minutes there was no visual indication that the deposit was softening.

EXAMPLE 6

One example (6A) of a composition without quaternary ammonium surfactant and three comparative examples (6C, 6D and 6E) with varying amounts of quaternary ammonium surfactant were prepared. The pH of the compositions was from about 9 to about 10. The compositions were as follows:

| Ingredient | Example 6A % by weight | Comparative Example 6B % by weight | Comparative Example 6C % by weight | Comparative Example 6D % by weight |
|---|---|---|---|---|
| Polyhydroxy Fatty Acid Amide Surfactant | 0.64 | 0.64 | 0.64 | 0.64 |
| Amine Oxide Surfactant | 0.54 | 0.54 | 0.54 | 0.54 |
| Quaternary Ammonium Surfactant | 0 | 1 | 2 | 3 |
| Potassium Bicarbonate | 12 | 12 | 12 | 12 |
| Glycerol | 50 | 50 | 50 | 50 |
| Water | Balance | Balance | Balance | Balance |

The example composition and comparative example compositions were tested as described in Example 2. The results were as follows:

| Composition | Results (% deposit removed) |
|---|---|
| Example 6A | 99 |
| Comparative Example 6B | 10 |
| Comparative Example 6C | 28 |
| Comparative Example 6D | 18 |

The addition of quaternary ammonium surfactant decreased the effectiveness of the compositions.

Having shown and described preferred embodiments of the present invention, further adaptions of the compositions and methods described herein can be accomplished by appropriate modification by one of ordinary skill in the art without departing from the scope of the present invention. A number of alternatives and modifications have been described herein, and others will be apparent to those skilled in the cart. Accordingly, the scope of the present invention should be considered in terms of the following claims, and is understood not to be limited to the details of the compositions and methods described in the specification.

What is claimed is:

1. A cleaning composition comprising, by weight,:

(a) from about 0.5% to about 10% of polyhydroxy fatty acid amide surfactants having the formula:

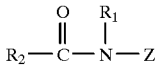

wherein $R_1$ is H, methyl, ethyl, propyl, butyl, 2-hydroxyl ethyl or 2-hydroxy propyl;

$R_2$ is a $C_5$–$C_{31}$ hydrocarbyl; and

Z is a polyhydroxyhydrocarbyl having a linear hydrocarbyl chain with at least 3 hydroxyls directly connected to the chain, or an alkoxylated derivative of said polyhydroxyhydrocarbyl wherein at least one of the hydroxyls is alkoxylated;

(b) from about 0% to about 10% of amine oxide surfactants having the formula:

$$R_3R_4R_5N\rightarrow O$$

wherein $R_3$ is an alkyl having from about 8 to about 16 carbon atoms; and $R_4$ and $R_5$ are each independently methyl or ethyl;

(c) from about 0.5% to about 10% of an amine;

(d) from about 0% to about 12% of an alkalinity source other than amine;

(e) greater than about 20% of a polyhydric alcohol other than the polyhydroxy fatty acid amide surfactant; and (f) water; and wherein the composition has a pH of no less than about 8.

2. A cleaning composition according to claim 1 wherein the cleaning composition is a cooking surface cleaning composition.

3. A composition according to claim 1 comprising from about 0.5% to about 10% of amine oxide surfactants.

4. A composition according to claim 3 wherein the weight ratio of polyhydroxy fatty acid amide surfactant to amine oxide surfactant is from about 3:1 to about 1:3.

5. A composition according to claim 1 having a total surfactant content of from about 0.5% to about 10%, by weight.

6. A composition according to claim 1 wherein the alkalinity source other than amine is selected from the group consisting of alkali metal bicarbonate salts, alkali metal carbonate salts, alkali metal hydroxides and mixtures thereof.

7. A composition according to claim 1 wherein the polyhydric alcohol other than the polyhydroxy fatty acid amide surfactant is selected from the group consisting of glycerol, diethylene glycol, triethylene glycol and mixtures thereof.

8. A composition according to claim 1 wherein the composition has a flashpoint of no less than about 100° F.

9. A composition according to claim 1 wherein the polyhydroxy fatty acid amide surfactant has the formula:

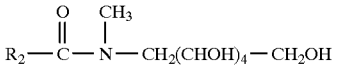

wherein $R_2$ is a $C_5$–$C_{31}$ hydrocarbyl.

10. A composition according to claim 1 wherein the amine oxide surfactant has the formula:

$$R_3(CH_3)_2N\rightarrow O$$

wherein $R_3$ is an alkyl having from about 12 to about 16 carbon atoms.

11. A cleaning composition according to claim 1 comprising, by weight:

(a) from about 0.5% to about 5% of the polyhydroxy fatty acid amide surfactant;

(b) from about 0.5% to about 5% of the amine oxide surfactant;

(c) from about 5% to about 7% of the amine;

(d) from about 0% to about 5% of the alkalinity source other than amines;

(e) from about 30% to about 60% of the polyhydric alcohol other than the polyhydroxy fatty acid amide surfactant; and (f) at least about 30% water.

12. A cleaning composition according to claim 1 further comprising from about 0% to about 0.2%, by weight, thickener.

13. A composition according to claim 1 wherein the composition has a pH of from about 9 to about 12.

14. A composition according to claim 1 wherein the composition has a pH of from about 12 to about 14.

15. A cleaning composition comprising, by weight:

(a) from about 0.5% to about 10% of polyhydroxy fatty acid amide surfactants having the formula:

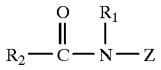

wherein $R_1$ is H, methyl, ethyl, propyl, butyl, 2-hydroxyl ethyl or 2-hydroxy propyl;

$R_2$ is a $C_5$–$C_{31}$ hydrocarbyl; and

Z is a polyhydroxyhydrocarbyl having a linear hydrocarbyl chain with at least 3 hydroxyls directly connected to the chain, or an alkoxylated derivative of said polyhydroxyhydrocarbyl wherein at least one of the hydroxyls is alkoxylated;

(b) from about 0% to about 10% of amine oxide surfactants having the formula:

$$R_3R_4R_5N\rightarrow O$$

wherein $R_3$ is an alkyl having from about 8 to about 16 carbon atoms; and $R_4$ and $R_5$ are each independently methyl or ethyl;

(c) from about 1% to about 16% of an alkalinity source other than amine;

(d) from about 30% to about 60% of a polyhydric alcohol other than the polyhydroxy fatty acid amide surfactant; and (e) water; and wherein the composition has a total surfactant content of from about 0.5% to about 10%, and wherein the composition has a pH of no less than about 8.

16. A cleaning composition according to claim 15 wherein the alkalinity source other than amine is potassium bicarbonate.

17. A cleaning composition according to claim 15 further comprising from 0.5% to about 10% of an amine and wherein the composition is capable of softening deposits on unheated cooking surfaces.

18. A cleaning composition according to claim 17 comprising, by weight:

(a) from about 0.5% to about 5% of the polyhydroxy fatty acid amide surfactant;

(b) from about 0.5% to about 5% of the amine oxide surfactant;

(c) from about 2% to about 10% of the amine;

(d) from about 1% to about 16% of an alkalinity source selected from the group consisting of alkali metal bicarbonate salts, alkali metal carbonate salts, alkali metal hydroxides and mixtures thereof;

(e) from about 30% to about 60% of a polyhydric alcohol selected from the group consisting of glycerol, diethylene glycol, triethylene glycol and mixtures thereof; and (f) at least about 30% water; and wherein the weight ratio of fatty acid amide surfactant to amine oxide surfactant is from about 3:1 to about 1:3.

19. A method of cleaning deposits from hard surfaces, comprising the steps of:

(a) applying to the cooking surface a cleaning composition comprising, by weight,:

(1) from about 0.5% to about 10% of polyhydroxy fatty acid amide surfactants having the formula:

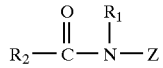

wherein $R_1$ is H, methyl, ethyl, propyl, butyl, 2-hydroxyl ethyl or 2-hydroxy propyl;

$R_2$ is a $C_5$–$C_{31}$ hydrocarbyl; and

Z is a polyhydroxyhydrocarbyl having a linear hydrocarbyl chain with at least 3 hydroxyls directly connected to the chain, or an alkoxylated derivative of said polyhydroxyhydrocarbyl wherein at least one of the hydroxyls is alkoxylated;

(2) from about 0% to about 10% of amine oxide surfactants having the formula:

$$R_3R_4R_5N\rightarrow O$$

wherein $R_3$ is an alkyl having from about 8 to about 16 carbon atoms; and $R_4$ and $R_5$ are each independently methyl or ethyl;

(3) from about 0.5% to about 10% of an amine;

(4) from about 0% to about 12% of an alkalimty source other than amines;

(5) from about 30% to about 60% of a polyhydric alcohol other than the polyhydroxy fatty acid amide surfactant; and (6) water;

(b) waiting a sufficient time for the composition to soften the deposits; and (c) removing the composition and the softened deposits.

20. A method according to claim 19 wherein the cleaning surface is unheated.

* * * * *